US005404150A

United States Patent [19]

Murata

[11] Patent Number: 5,404,150

[45] Date of Patent: Apr. 4, 1995

[54] LIQUID CRYSTAL DISPLAY APPARATUS

[75] Inventor: Tetsuo Murata, Tenri, Japan

[73] Assignee: Sharp Kabushiki Kaisha, Japan

[21] Appl. No.: 139,063

[22] Filed: Oct. 21, 1993

Related U.S. Application Data

[63] Continuation of Ser. No. 735,917, Jul. 25, 1991, abandoned.

[30] Foreign Application Priority Data

Sep. 3, 1990 [JP] Japan ..... 2-233487

[51] Int. Cl.[6] ..... G09G 3/36

[52] U.S. Cl. ..... 345/95; 343/90; 343/211

[58] Field of Search ..... 345/87, 89, 94, 95, 345/96, 98, 208, 209, 210, 211; 348/790, 791, 792, 793; 340/784, 805; 358/236, 241

[56] References Cited

U.S. PATENT DOCUMENTS

| | | | |
|---|---|---|---|
| 4,380,008 | 4/1983 | Kawakami et al. | 340/805 |
| 4,395,709 | 7/1983 | Nagae et al. | 345/98 |
| 4,523,232 | 6/1985 | Kameda et al. | 358/236 |
| 4,642,693 | 2/1987 | Fuse et al. | 358/236 |
| 4,702,560 | 10/1987 | Endo et al. | 340/784 |
| 4,746,196 | 5/1988 | Umeda et al. | 340/805 |
| 4,769,639 | 9/1988 | Kawamura | 340/784 |
| 4,824,211 | 4/1989 | Murata | 340/784 |
| 4,901,066 | 2/1990 | Kobayashi | 340/784 |
| 4,945,352 | 7/1990 | Ejiri | 340/784 |
| 4,952,032 | 8/1990 | Inoue et al. | 340/784 |
| 5,093,655 | 3/1992 | Tanioka et al. | 340/805 |
| 5,111,319 | 5/1992 | Morris | 340/805 |

FOREIGN PATENT DOCUMENTS

| | | | |
|---|---|---|---|
| 0360523 | 3/1990 | European Pat. Off. | 340/284 |
| 61-141493 | 6/1986 | Japan . | |

*Primary Examiner*—Ulysses Weldon
*Assistant Examiner*—Gin Goon
*Attorney, Agent, or Firm*—Nixon & Vanderhye

[57] ABSTRACT

In order to improve the contrast of a liquid crystal display device by the voltage equalization method, scanning side electrodes totaling D in number are scanned in line sequential fashion while applying a voltage between each selected scanning side electrode and each signal side electrode, the voltage applied being controlled in such a way that, during a total of D times of scanning of the scanning side electrodes for production of one frame, when a particular scanning side electrode and a particular signal side electrode are simultaneously in a select state, a voltage Vop is applied to the corresponding liquid crystal, and when the scanning side electrodes respectively are in a non-select state, which occurs the remaining (D−1) times for each of the scanning side electrodes, a voltage whose polarity is reversed in response to the select and non-select states of the signal side electrodes and whose absolute value is represented by |Vop/B|, where B is the bias ratio, is applied to the corresponding liquid crystal. The bias ratio B can be varied to adjust the contrast of the liquid crystal display device, and it is possible to improve the contrast by increasing the bias ratio.

10 Claims, 5 Drawing Sheets

LIQUID CRYSTAL DISPLAY APPARATUS

This is a continuation of application Ser. No. 07/735,917, filed Jul. 25, 1991, now abandoned.

BACKGROUND OF THE INVENTION

1. Field of the Invention

The present invention relates to a liquid crystal display apparatus, and more particularly to a construction for adjusting the contrast of the same.

2. Description of the Prior Art

In X-Y dot matrix liquid crystal display apparatuses, the liquid crystal has the cumulative response characteristic that it responds to the sum of the effective voltages of an applied voltage pulse for several ten to hundred milliseconds. Interference generally known as crosstalk, tends to occur in which ON or OFF display information for an attention pixel is affected by display information for other pixels on the scanning side electrode and the signal side electrode that intersect each other at the attention pixel. To prevent such interference, the so-called voltage equalization method is employed to drive the liquid crystal. In such liquid crystal display apparatuses, adjusting the contrast, i.e., difference in pixel display density between ON and OFF, is essential to compensate for the temperature characteristic and viewing angle characteristic of liquid crystal, variations in threshold voltages between liquid crystals, and the viewer's liking with respect to the contrast.

FIG. 1 is an electrical circuit diagram of a portion of a typical prior art construction. The voltage from a DC power supply 1 is divided through four resistors R and one registor Rx so that voltages V10–V15 are derived through impedance converters A1–A5 to obtain a voltage Vop between the voltages V10 to V15, the voltage Vop being varied by means of a variable resistor Ry thereby adjusting the contrast of the liquid crystal. The voltages V10–V15 are supplied to an X-Y dot matrix liquid crystal display apparatus through a driving circuit composed of semiconductor integrated circuits, etc., to drive the liquid crystal by the voltage equalization method.

In the voltage equalization method, the relationship between the voltage Vop and the effective voltage value VON applied to pixels selected for energization is expressed by equation (1), while the voltage VOFF applied to non-selected liquid crystal segments that are set to OFF state is expressed by equation (2).

$$VON = \frac{Vop}{B}\sqrt{\frac{B^2 + D - 1}{D}} \quad (1)$$

$$VOFF = \frac{Vop}{B}\sqrt{\frac{(B-2)^2 + D - 1}{D}} \quad (2)$$

where B is the bias ratio, and D is the number of scanning side electrodes.

FIG.2 is a graph showing the relationship of the voltages VON and VOFF relative to the light transmittance of liquid crystal. The voltage VOFF is set at a value close to the threshold voltage Vth at which the energization of the liquid crystal just occurs.

To increase the contrast, it is desirable to determine the bias ratio B in such a manner as to maximize the ratio of the voltage VON to VOFF. The bias ratio at which VON/VOFF is the maximum is given as:

$$B = \sqrt{D} + 1 \quad (3)$$

The temperature characteristic of liquid crystal is such that, as shown in FIG. 3, a higher voltage VON is necessary at lower temperature to energize the liquid crystal to the desired contrast. Also, the voltage VON at which the desired contrast is achieved varies from one liquid crystal display apparatus to another, and further, the desired contrast varies according to the taste of the viewer. Therefore, a construction that can adjust the voltage VON is needed.

Usually, the upper limit value of the voltage Vop is determined by the withstanding voltage of the driving circuit composed of semiconductor integrated circuits to which the voltages V10–V15 are supplied. On the other hand, the voltage VON is set at the highest value considered necessary at low temperature, and further, the number of scanning side electrodes, D, is predetermined. Using these values, the bias ratio B is calculated from the aforementioned equation (1). In equation (1), if the voltage Vop is small, or if the value D is large, the bias ratio B cannot be set to the optimum value shown in equation (3).

In the prior art, the bias ratio B is set at a relatively small value in consideration of the upper limit of the voltage Vop so that a large value which becomes necessary can be provided as the voltage VON. When the bias ratio B is set at such a small value, the ratio VON/VOFF approaches 1, presenting the problem of decreased contrast.

In the prior art construction shown in FIG. 1, the bias ratio B is fixed to a value expressed by equation (4) below, while the variable resistor Ry is varied to vary the voltage Vop, thereby adjusting the voltage VON. In equation (4), the resistance values of the resistors R and Rx and the variable resistor Ry are represented by the same reference sign.

$$B = \frac{4R + Rx}{R} \quad (4)$$

To sum up, in the prior art, the bias ratio B is fixed to a relatively small value in consideration of the upper limit value of the voltage Vop under the condition that requires the highest voltage VON; therefore, the problem is that the bias ratio B is significantly shifted from the bias ratio specifically shown by equation (3), thus resulting in poor contrast.

SUMMARY OF THE INVENTION

It is an object of the invention to provide a liquid crystal display apparatus in which an improvement in contrast is achieved.

The invention provides a liquid crystal display apparatus in which scanning side electrodes totaling D in number are scanned in line sequential fashion while applying a voltage between each selected scanning side electrode and each signal side electrode, the voltage applied being controlled in such a way that, during a total of D times of scanning of the scanning side electrodes for production of one frame, when a particular scanning side electrode and a particular signal side electrode are simultaneously in a select state, a voltage Vop is applied to the corresponding liquid crystal, and when the scanning side electrodes respectively are in a non-select state, which occurs the remaining (D−1) times for each of the scanning side electrodes, a voltage whose polarity is reversed in response to the select and non-select states of the signal side electrodes and whose absolute value is represented by |Vop/B|, where B is the bias ratio, is applied to the corresponding liquid crystal, the bias ratio B being varied to adjust the contrast of the liquid crystal display.

According to the invention, an X-Y dot matrix liquid crystal display apparatus is realized using the scanning side electrodes and signal side electrodes, in which the scanning side electrodes are scanned in line sequential fashion for driving the liquid crystal so that, during a total of D times of scanning of the scanning side electrodes for production of one frame, when a particular scanning side electrode and a particular signal side electrode are simultaneously in a select state, a voltage Vop is applied to the corresponding liquid crystal to illuminate the selected pixel; on other hand, when the scanning side electrodes respectively are in a non-selected state, which occurs the remaining (D−1) times for each of the scanning side electrodes, a voltage whose polarity is reversed in response to the select and non-select states of the signal side electrodes and whose absolute value is represented by |Vop/B|, where B is the bias ratio, is applied to the corresponding liquid crystal, thus driving the liquid crystal by the so-called voltage equalization method, by which the voltages applied to the liquid crystal during the non-select period occurring (D−1) times on each scanning side electrode are equalized to |Vop/B| regardless of the select (display-on of other pixels) or non-select (display-off of other pixels) state of the signal side electrodes.

According to the invention, the bias ratio is varied to adjust the contrast. Therefore, with the voltage Vop set to a value close to the upper limit value of the withstanding voltage of the drive circuits composed of semiconductor integrated circuits, etc., the bias ratio B can be varied to adjust the contrast as mentioned above, while achieving the adjustment of the voltage VON. Thus, according to the invention, the bias ratio B can be set so as to bring the voltage VON to the desirable value for normal operation condition, and therefore, the bias ratio B can be set at a larger value than that in the aforementioned prior art, so as to bring it closer to the optimum bias ratio expressed by equation (3). According to the prior art, since the bias ratio B is determined in accordance with equation (1) in consideration of the largest value that may become necessary as the voltage VON, the bias ratio B is set at a relatively small value. On the other hand, according to the invention, the bias ratio B is varied to adjust the voltage VON to a value necessary for normal operating condition; therefore, the bias ratio B can be brought close to the optimum value. In the prior art, when the value D is large or when the upper limit value of the voltage Vop is small, the bias ratio B is significantly shifted from the optimum value given by equation (3), but, as described above, the present invention provides effective means to solve this problem.

Thus, according to the invention, when driving an X-Y dot matrix liquid crystal display apparatus or the like by the so-called voltage equalization method, the bias ratio B can be varied so as to improve the contrast as compared with the prior art, and it is also possible to adjust the driving voltage VON for illumination of the liquid crystal, thus improving the display quality. In normal operation condition, a high driving voltage is generally not necessary for illumination of the liquid crystal. Therefore, the bias ratio B can be adjusted to a larger value than that in the prior art, which makes it possible to bring the bias ratio B to the optimum value given by the aforementioned equation (3). Accordingly, the invention is particularly effective when the number of scanning side electrodes, D, is large or when the upper limit value of the voltage Vop is small, since the bias ratio B close to the optimum value given by equation (3) for normal operation condition can be used.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
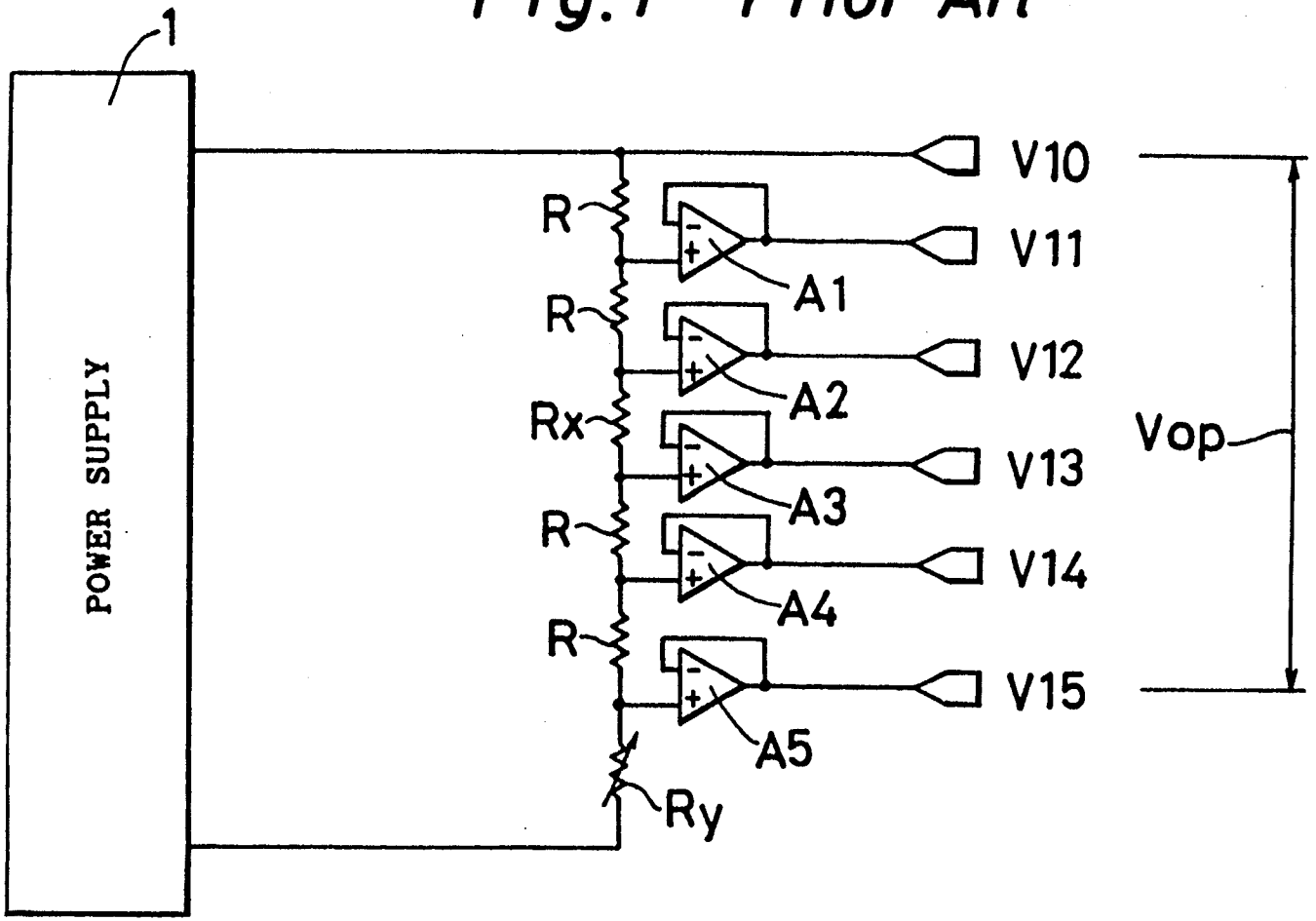
Fig. 1 Prior Art
FIG. 1 is an electrical circuit diagram of a portion of a prior art construction.
Figure 2:
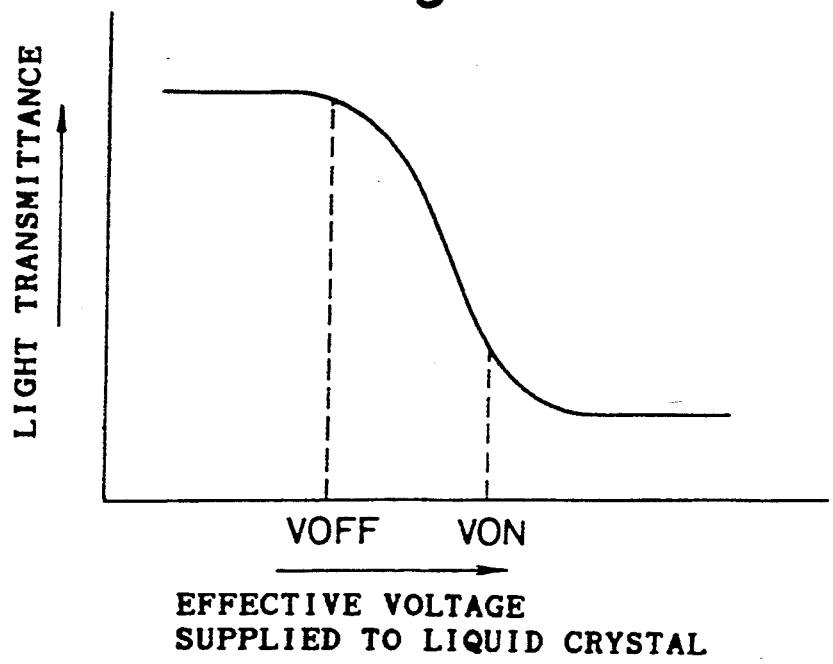
Fig.2 Prior Art
FIG. 2 is a graph showing the relationship between the effective voltage and light transmittance of the liquid crystal.
Figure 3:
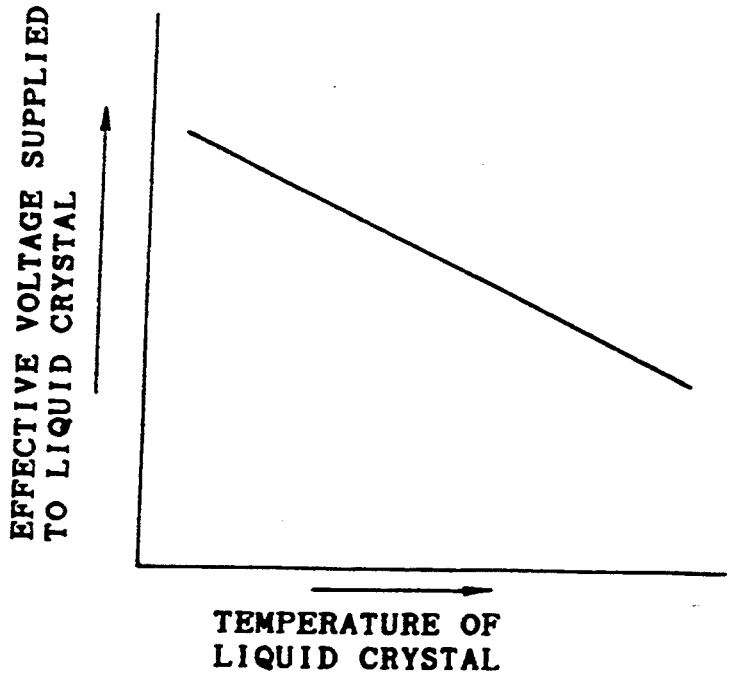
Fig.3 Prior Art
FIG. 3 is a graph showing the relationship between the ambient temperature of the liquid crystal and the voltage VON applied to the liquid crystal necessary to obtain the desired contrast.

Now referring to the drawing, preferred embodiments of the invention are described below.

Figure 4:
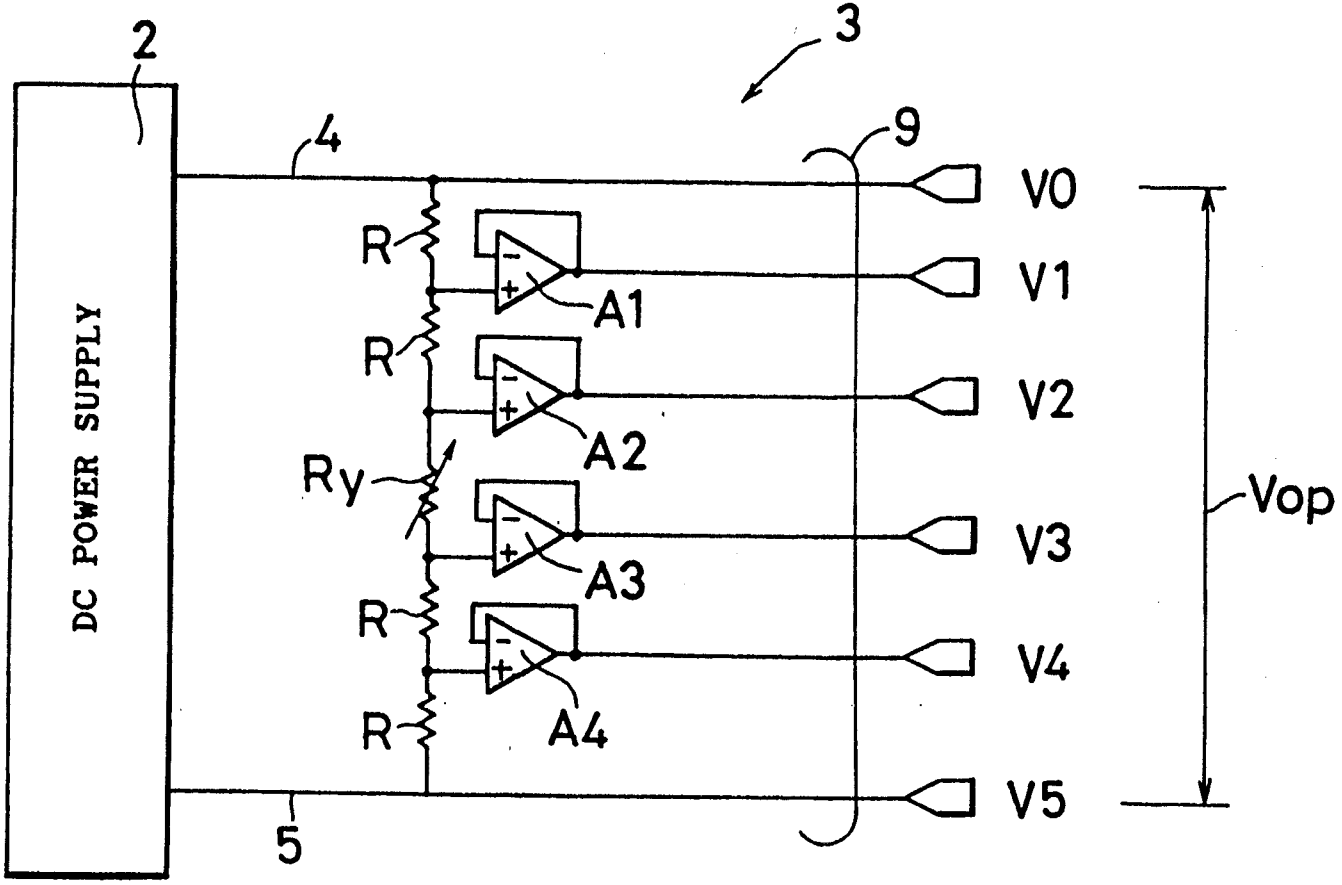
FIG. 4 is an electrical circuit diagram showing the specific configuration of a drive voltage generating circuit 3 in one embodiment of the invention.

FIG. 4 is an electrical circuit diagram showing the specific configuration of a drive voltage generating circuit 3 in one embodiment of the invention. In the drive voltage generating circuit 3, a voltage Vop from a DC power supply 2 is developed between lines 4 and 5 and divided through four resistors R and a resistor Ry disposed at the center of the resistor chain, to obtain voltages V1–V4 via impedance converters A1–A4, along with voltages V0 and V5 between the lines 4 and 5.

Figure 5:
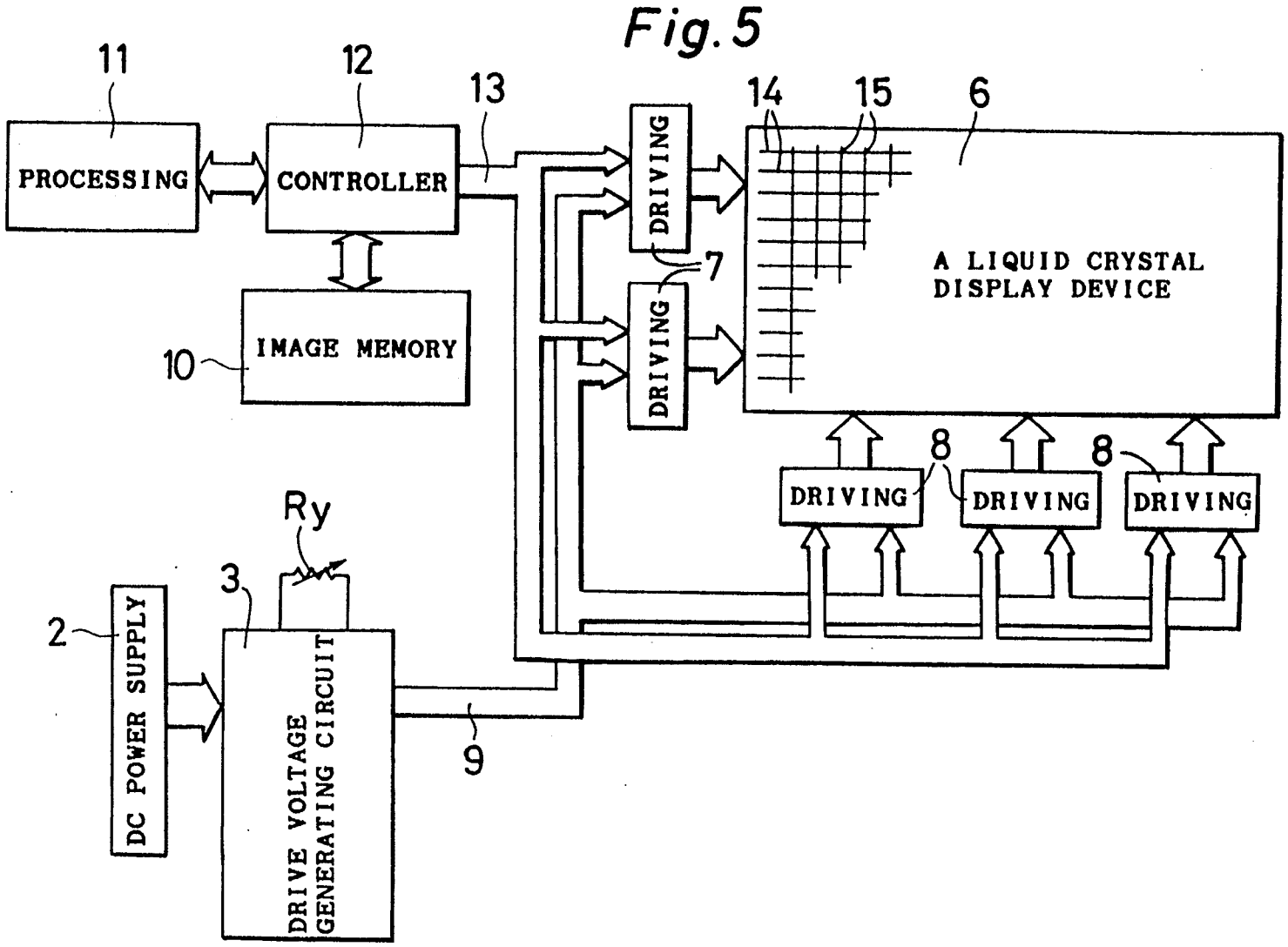
FIG. 5 is a block diagram of a liquid crystal display apparatus having the drive voltage generating circuit 3 shown in FIG. 4.

FIG.5 is a block diagram-of a liquid crystal display apparatus of one embodiment of the invention having the thus constructed drive voltage generating circuit 3. A liquid crystal display device 6 driven by the circuit is provided with 160 scanning side electrodes 14 extending horizontally from right to left in FIG.5 and 240 signal side electrodes 15 extending vertically from top to bottom in FIG. 5, forming an X-Y dot matrix array, the number of dots being 240×160.

A driving circuit 7 composed of semiconductor integrated circuits is provided for driving the scanning side electrodes 14, while a driving circuit 8 composed of semiconductor integrated circuits is provided for driving the signal side electrodes 15. The drive voltages V0–V5 from the drive voltage generating circuit 3 are supplied to these driving circuits 7 and 8 via a line 9.

Image data to be displayed on the liquid crystal display device 6 is stored in an image memory 10. Under the control of a processing circuit 11 composed of a microcomputer or the like, a controller 12 composed of a semiconductor integrated circuit supplies a digital control signal for driving the liquid crystal to the driving circuits 7 and 8 via a line 13. For the liquid crystal display device 6 to produce the display of one frame, a select voltage is sequentially applied to the scanning side electrodes 14 one line at a time, while display side electrode signals corresponding to the respective pixels on the selected scanning side electrode 15 are applied simultaneously to the signal side electrodes 15 intersecting the scanning side electrode 15 to produce the display for one line of scanning side electrode, the operation being repeated until the full screen is covered, to complete the display of one frame. The line sequential driving is thus performed. To prevent direct current from being applied continuously to the liquid crystal and thereby extend the life of the liquid crystal, an alternating current driving method is employed in which the polarity of the waveform applied to each of the electrodes 14 and 15 is alternately reversed from one frame to another. Also, in order to suppress the occurrence of crosstalk due to the cumulative response characteristic of liquid crystal, the liquid crystal is driven by the voltage equalization method. In Tables 1 and 2 below, voltages with a sign + or − represent the potential differences applied to the liquid crystal by the voltages applied to the scanning side electrode 14 and the signal side electrode 15, each potential difference representing the result obtained by subtracting the voltage of the signal side electrode 15 from the voltage of the scanning side electrode 14.

TABLE 1

| | | Signal side electrode 15 | |
|---|---|---|---|
| Scanning side electrode 14 | | Select 0 | Non-select 2Vop/B |
| Select | Vop | + Vop | $+\left(1-\frac{2}{B}\right)Vop$ |
| Non-select | Vop/B | + Vop/B | −Vop/B |

TABLE 2

| | | Signal side electrode 15 | |
|---|---|---|---|
| | Scanning side electrode 14 | Select Vop | Non-select $\left(1-\frac{2}{B}\right)Vop$ |
| Select | 0 | − Vop | $-\left(1-\frac{2}{B}\right)Vop$ |
| Non-select | $\left(1-\frac{1}{B}\right)Vop$ | − Vop/B | + Vop/B |

The voltages applied to the liquid crystal have the same absolute value but opposite polarities when the combination of the states of the electrodes 14 and 15 is the same.

Thus, the voltages applied to the liquid crystal during the non-select period occurring (D−1) times on the scanning side electrode 14 are equalized to ±Vop/B regardless of the select (that is, display-on of other pixels) or non-select (that is, display-off of other pixels) state of the signal side electrode 15. By alternately applying the voltages shown in Tables 1 and 2 from one frame to another, the polarity of the applied waveform is reversed between the frames to drive the liquid crystal by AC thus serving to extend the life of the liquid crystal. When the voltages to be applied to the electrodes 14 and 15 are determined as shown in Tables 1 and 2, the voltages applied to the liquid crystal at each pixel during the select and non-select periods of the scanning side electrode 14 are given as follows:

(1) a voltage is applied to the liquid crystal once per frame when the scanning side electrode 14 is in a select state, the voltage being
  (1-1) +Vop or −Vop when the pattern to be displayed is ON and
  (1-2) +(1-2/B)Vop or −(1-2/B)Vop when the pattern to be displayed is OFF; and
(2) when the scanning side electrode 14 is in a non-select state, a voltage of +Vop/B or −Vop/B is applied to the liquid crystal (D−1) times per frame regardless of the display pattern.

Figure 6:
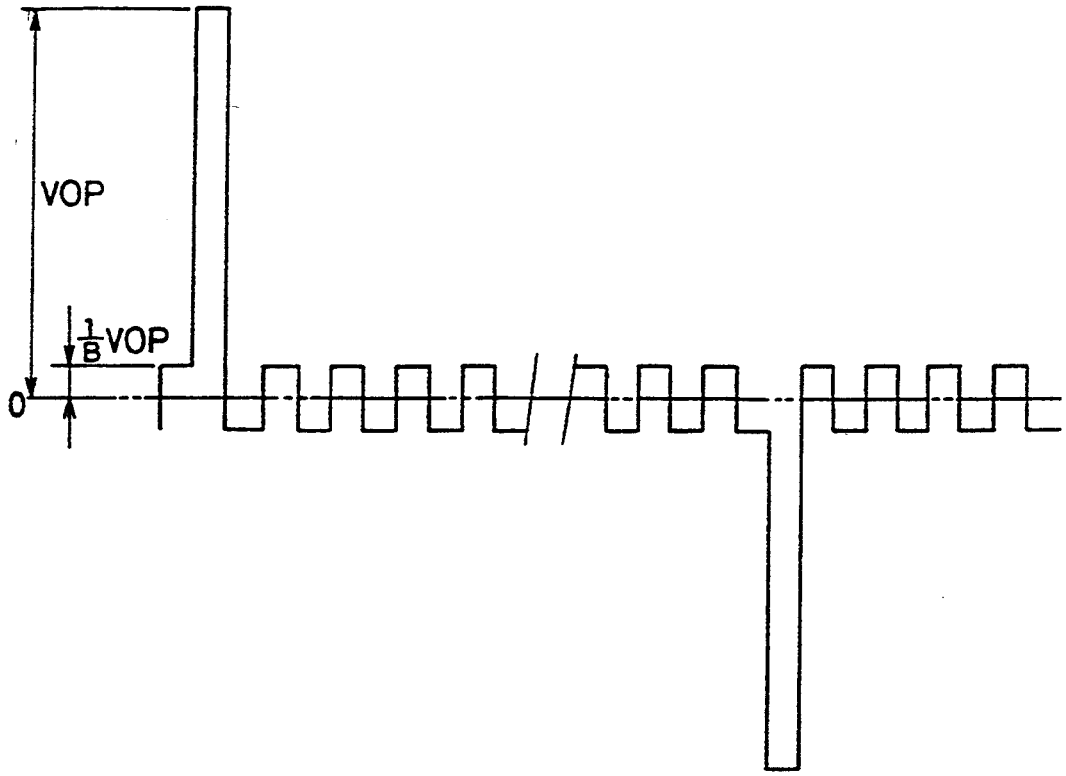
FIG. 6 is a diagram showing a typical waveform applied to the liquid crystal in a liquid crystal display device 6 by means of driving circuits 7 and 8.

With reference to the effective voltage applied to each pixel of the liquid crystal during one frame period, the energization voltage VON for the ON pattern is as shown in the aforementioned equation (1), and the effective voltage VOFF, an unenergization signal for the OFF pattern, is as shown in the aforementioned equation (2). A typical waveform applied to the liquid crystal is shown in FIG. 6. As described, during a total of D times of scanning of the scanning side electrodes 14 for production of one frame, when a particular scanning side electrode 14 and a particular signal electrode 15 are simultaneously in a select state, the voltage Vop is applied to the corresponding liquid crystal, and when the scanning side electrodes 1.4 respectively are in a non-select state, which occurs the remaining (D−1) times for each of the scanning side electrodes 14, a voltage whose polarity is reversed in response to the select and non-select states of the signal electrodes 15 and whose absolute value is represented by |Vop/B|, where B is the bias ratio, is applied to the corresponding liquid crystal, thereby achieving the driving of the liquid crystal by the voltage equalization method.

Referring back to FIG. 4, the bias ratio B according to the embodiment of the invention is expressed by equation below.

$$B = \frac{4R + Ry}{R} \tag{5}$$

The bias ratio B expressed by the above equation (5) can be varied by varying the variable resistor Ry. Therefore, since, while the voltage Vop is fixed to a value close to the upper limit value of the withstanding voltage of the driving circuits 7 and 8, the voltage VON is set at a value suitable for normal operating conditions and the number D of scanning side electrodes is predetermined, the bias ratio B can be set to a larger value than that in the aforementioned prior art. This contributes to an improved contrast and also makes it possible to increase the voltage VON. Furthermore, since the variable resistor Ry is provided between the impedance converters A2 and A3 with the four resistors R disposed vertically in symmetric fashion with respect to the variable resistor Ry, it is possible to form the voltages V1–V4 symmetrically and thus drive the liquid crystal by a perfect alternating current waveform.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A liquid crystal display apparatus in which:

scanning side electrodes totaling D in number are scanned in line sequential fashion while applying a voltage between each selected scanning side electrode and each signal side electrode, the voltage applied being controlled in such a way that, during a total of D times of scanning of the scanning side electrodes for production of one frame, when a particular scanning side electrode and a particular signal side electrode are simultaneously in a select state, a voltage Vop is applied to the corresponding liquid crystal, and when the scanning side electrodes respectively are in a non-select state, which occurs the remaining (D−1) times for each of the scanning side electrodes, a voltage whose polarity is reversed corresponding to the select and non-select states of the signal side electrodes and whose absolute value is represented by |Vop/B|, where B is the bias ratio, is applied to the corresponding liquid crystal, the bias ratio B being varied to adjust the contrast of the liquid crystal display in response to viewer input, the viewer input adjusting an adjustable resistor Ry of a voltage division circuit; the voltage division circuit including a resistor chain constructed with an even n number of first resistors R connected in series and having an identical resistance value, the adjustable resistor Ry being symmetrically connected in series with the first resistors R at the center of the resistor chain for dividing an output Vop of the DC power supply.

2. A liquid crystal display apparatus comprising:

a liquid crystal display device in which liquid crystal is sandwiched between a plurality of scanning side electrodes totaling D in number and a plurality of signal side electrodes disposed intersecting the scanning side electrodes at right angles;

a DC power supply;

a voltage dividing circuit, the voltage dividing circuit including a resistor chain constructed with an even number n of first resistors R connected in series and having an identical resistance value, the voltage dividing circuit also including a second resistor Ry symmetrically connected in series with the first resistors R at the center of the resistor chain, for dividing an output Vop of the DC power supply, the second resistor Ry being continuously variable during operation to change a basis ratio B and thereby adjust a contrast of the liquid crystal display;

image data generating means for generating image data to be displayed on the liquid crystal display device; and driving means responsively connected to the image data generating means for supplying divided voltages from the dividing circuit to the scanning side electrodes and signal side electrodes, the driving of the liquid crystal being controlled in such a way that, out of D times of scanning of the scanning side electrodes for one frame, (1) a voltage is applied to the liquid crystal once per frame when the associated scanning side electrode is in a select state, the voltage being (a) +Vop or −Vop when the pattern to be displayed is ON, and (b) +(1-2/B)Vop or −(1-2/B)Vop when the pattern to be displayed is OFF, and (2) when the scanning side electrode is in a non-select state, a voltage Vop/B or −Vop/B, the polarity being reversed alternately from one frame to another, is applied to the liquid crystal (D−1) times per frame regardless of the display pattern, where B=(n·R+Ry)/R.

3. A liquid crystal display apparatus as set forth in claim 2, wherein the second resistor Ry is a variable resistor.

4. A liquid crystal display apparatus as set forth in claim 3, wherein Ry is variable in response to viewer input to adjust the contrast of the liquid crystal display.

5. A liquid crystal display apparatus comprising:

a liquid crystal display device in which liquid crystal is sandwiched between a plurality of scanning side electrodes and a plurality of signal side electrodes disposed intersecting the scanning side electrodes;

a DC power supply;

a voltage division circuit for dividing an output Vop of the DC power supply, the voltage division circuit having a bias ratio B associated therewith, wherein the voltage division circuit includes a resistor chain constructed with an even number n of first resistors R connected in series and having an identical resistance value, the voltage dividing circuit also including a second resistor Ry symmetrically connected in series with the first resistors R at the center of the resistor chain, for dividing an output VOP of the DC power supply, the second resistor Ry being continuously variable during operation to change a basis ratio B and thereby adjust a contrast of the liquid crystal display;

image data generating means for generating image data to be displayed on the liquid crystal display device; and driving means responsively connected to the image data generating means for supplying divided voltages from the division circuit to the scanning side electrodes and signal side electrodes, the driving of the liquids crystal being controlled whereby:

(1) voltages are applied to the scanning side electrode and the signal side electrode for a first frame as follows:

(a) a voltage VOP is applied to the scanning side electrode and 0 voltage is applied to the signal side electrode when the liquid crystal is in a select state;

(b) a voltage is applied to the scanning side electrode and a voltage 2Vop/B is applied to the signal side electrode when the liquid crystal is in an OFF state; and (2) voltages are applied to the scanning side electrode and the signal side electrode for a subsequent frame as follows:

(a) 0 voltage is applied to the scanning side electrode and a voltage Vop is applied to the signal side electrode when the liquid crystal is in a select state;

(b) 0 voltage is applied to the scanning side electrode and a voltage (1-2/B)Vop is applied to the signal side electrode when the liquid crystal is in an OFF state.

6. A liquid crystal display apparatus as set forth in claim 5, wherein for the first frame a voltage Vop/B is applied to the scanning side electrode and a voltage selected from a set consisting of 0 and 2Vop/B is applied to the signal side electrode when the scanning side electrode is in a non-select state;

and for the subsequent frame a voltage (1-1/B)Vop is applied to the scanning side electrode and a voltage selected from a set consisting of Vop and (1-2/B)Vop is applied to the signal side electrode when the scanning side electrode is in a non-select state.

7. A liquid crystal display apparatus as set forth in claim 5, wherein $B=(n \cdot R+Ry)/R$.

8. A liquid crystal display apparatus as set forth in claim 5, wherein the bias ratio B is variable in response to viewer input to adjust the contrast of the liquid crystal display.

9. A liquid crystal display apparatus comprising:

a liquid crystal display device in which liquid crystal is sandwiched between a plurality of scanning side electrodes and a plurality of signal side electrodes disposed intersecting the scanning side electrodes;

a DC power supply;

a voltage division circuit for dividing an output Vop of the DC power supply, the voltage division circuit having a bias ratio B associated therewith, wherein the voltage division circuit includes a resistor chain constructed with an even number n of first resistors R connected in series and having an identical resistance value, the voltage dividing circuit also including a second resistor Ry symmetrically connected in series with the first resistors R at the center of the resistor chain, for dividing an output Vop of the DC power supply, the second resistor Ry being continuously variable during operation to change the basis ratio B and thereby adjust a contrast of the liquid crystal display;

image data generating means for generating image data to be displayed on the liquid crystal display device; and driving means responsively connected to the image data generating means for supplying divided voltages from the dividing circuit to the scanning side electrodes and signal side electrodes, the driving of the liquid crystal being controlled whereby:

(1) voltages are applied to the scanning side electrode and the signal side electrode for a first frame as follows:

(a) a voltage Vop is applied to the scanning side electrode and 0 voltage is applied to the signal side electrode when the liquid crystal is in a select state;

(b) a voltage Vop is applied to the scanning side electrode and a voltage 2Vop/B is applied to the signal side electrode when the liquid crystal is in an OFF state;

(c) a voltage Vop/B is applied to the scanning side electrode and a voltage selected from a set consisting of 0 and 2Vop/B is applied to the signal side electrode when the scanning side electrode is in a non-select state; and (2) voltages are applied to the scanning side electrode and the signal side electrode for a subsequent frame as follows:

(a) 0 voltage is applied to the scanning side electrode and a voltage Vop is applied to the signal side electrode when the liquid crystal is in a select state;

(b) 0 voltage is applied to the scanning side electrode and a voltage (1-2/B)Vop is applied to the signal side electrode when the liquid crystal is in an OFF state;

(c) a voltage (1-1/B)Vop is applied to the scanning side electrode and a voltage selected from a set consisting of Vop and (1-2/B)Vop is applied to the signal side electrode when the scanning side electrode is in a non-select state.

10. A liquid crystal display apparatus as set forth in claim 9, wherein the bias ratio B is variable in response to viewer input to adjust the contrast of the liquid crystal display.

* * * * *